US006241130B1

(12) United States Patent
Heiberger

(10) Patent No.: US 6,241,130 B1
(45) Date of Patent: Jun. 5, 2001

(54) HAND-HELD SQUEEZING-OUT TOOL WITH A DRIVE MOTOR

(75) Inventor: Franz Heiberger, Stettfurt (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/431,455

(22) Filed: Nov. 1, 1999

(30) Foreign Application Priority Data

Nov. 2, 1998 (DE) ..... 198 50 495

(51) Int. Cl.[7] ..... B65D 88/54
(52) U.S. Cl. ..... 222/325; 222/326; 222/333
(58) Field of Search ..... 222/333, 325, 222/326, 327, 391

(56) References Cited

U.S. PATENT DOCUMENTS 4,264,021 * 4/1981 Davis, Jr. ..... 222/333

* cited by examiner

*Primary Examiner*—Joseph A. Kaufman
*Assistant Examiner*—David Deal

(74) *Attorney, Agent, or Firm*—Brown & Wood, LLP

(57) ABSTRACT

A tool for squeezing a single-component or multicomponent mass out of a film bag or a cartridge and including at least one piston rod (8), a displacement mechanism for displacing the piston rod (8) and including at least two axially displaceable clamping levers (10, 11) arranged on the piston rod (8) and pivotable in a longitudinal direction of the tool, with one of the at least two levers serving for displacement of the piston rod and another of the at least two levers serving for locking the piston at least two springs (12, 13) cooperating with the clamping levers (10, 11), a release lever (7) cooperating with the clamping levers (10, 11), and a drive mechanism for actuating the displacement mechanism and including a rotatable eccentric disc (17) cooperating with the piston rod-displacing lever.

7 Claims, 3 Drawing Sheets

HAND-HELD SQUEEZING-OUT TOOL WITH A DRIVE MOTOR

BACKGROUND OF THE INVENTION

1. Field of the Invention

The present invention relates to a tool for squeezing a single-component or multicomponent mass out of a film bag or a cartridge and including at least one piston rod connected with an element acting on the film bag or cartridge, a displacement mechanism for displacing the piston rod and including at least two axially displaceable clamping levers arranged on the piston rod and pivotable in a longitudinal direction of the tool, with one of the at least two levers serving for displacement of the piston rod and another of the at least two levers serving for locking the piston rod, at least two springs cooperating with the clamping levers, and a release lever cooperating with the clamping levers.

2. Description of the Prior Art

German Patent Publication DE-42 31 418 A1 discloses a tool for squeezing a single-component or multicomponent mass out of a film bag. The tool of this German reference includes at least two axially displaceable clamping levers mounted on a piston rod and pivotable in the longitudinal direction of the tool, two springs cooperating with the clamping levers, a discharge lever, and a release lever.

The first clamping lever, which cooperates with the discharge lever, serves for displacing the piston rod in a squeeze-out direction. The second lever serves for locking the piston rod or for preventing axial displacement of the piston rod relative to the tool housing. The release lever serves for releasing the piston rod from action of both clamping levers, so that the piston rod, after squeezing a film bag, can be manually returned to its initial position. Upon actuation of the release lever, both clamping levers are brought from their position, in which they are inclined to the longitudinal axis of the piston rod and clampingly engage the piston rod, into a neutral position in which they extend substantially transverse to the longitudinal axis of the piston rod.

During a squeezing out of large amounts of single-component or multicomponent masses, after some time, symptoms of fatigue appear in the operator which manifest themselves in that the operator can not completely push the discharge lever any more.

As a result of this, the piston rod is displaced in the squeeze-out direction only by a small amount each time the discharge lever is actuated. A maximal output speed cannot be achieved any more.

Accordingly, an object of the present invention is a tool for squeezing a single-component or a multi-component mass out of a film bag or a cartridge which would insure a reliable, fatigue-free delivery of the mass with a sufficiently high output speed, with the piston rod being displaced in the squeeze-out direction by a most possible amount.

SUMMARY OF THE INVENTION

This and other objects of the present invention, which will become apparent hereinafter, are achieved by providing a drive mechanism for effecting the displacement of the piston rod and including an eccentric disc which cooperates with the clamping lever that causes the displacement of the piston rod in the squeeze-out direction.

During the squeeze-out process, during which the squeezing of the film bag or the cartridge takes place, the piston rod of the inventive tool is displaced in the squeeze-out direction in a plurality of short, following one another intervals over a predetermined distance. For the distance, by which the piston rod is displaced, to be always the same, advantageously, the first, piston rod-displacing lever cooperates with the outer profile of the rotatable eccentric disc.

The length of the distance, by which the piston rod is displaced in the squeeze-out direction, depends on the eccentricity of the eccentric disc. Preferably, the eccentricity is selected within a range from about 5 mm to about 20 mm.

In order for the single-component or multicomponent mass to be squeezed out quickly, simply, and without the operator being tired, advantageously, the drive mechanism includes at least one drive motor with the output shaft of which the eccentric disc is operatively connected for joint rotation therewith. As a drive motor, an electric motor or, e.g., a vane motor, which is connected with a source of pressurized air, can be used.

Advantageously, a reducer is arranged between the eccentric disc and the drive motor for changing the rotational speed and a torque imparted from the drive motor to the eccentric disc.

In order to make the tool more compact and easy in operation, advantageously, the motor is turned on and off with an actuation switch. The actuation switch can be arranged, e.g., in the tool housing. However, preferably, the actuation switch is arranged in the handle which projects sidewise from an other part of the housing in which there is provided a receiving region in which a film bag or a cartridge is received. The arrangement of the actuation switch on the side of the handle facing in the squeeze-out direction insures an easy actuation of the switch by a finger of an operator's hand holding the handle.

Using an electric motor as a drive motor permits the use of the inventive tool at a work site where the only source of power is an electrical source. Advantageously, an accumulator is used as a power source for the electric drive motor. The accumulator can be detachably secured at the free end of the handle.

In order to make the tool more compact and user-friendly, the drive motor preferably is mounted in the handle. Naturally, the reducer can likewise be mounted in the handle.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
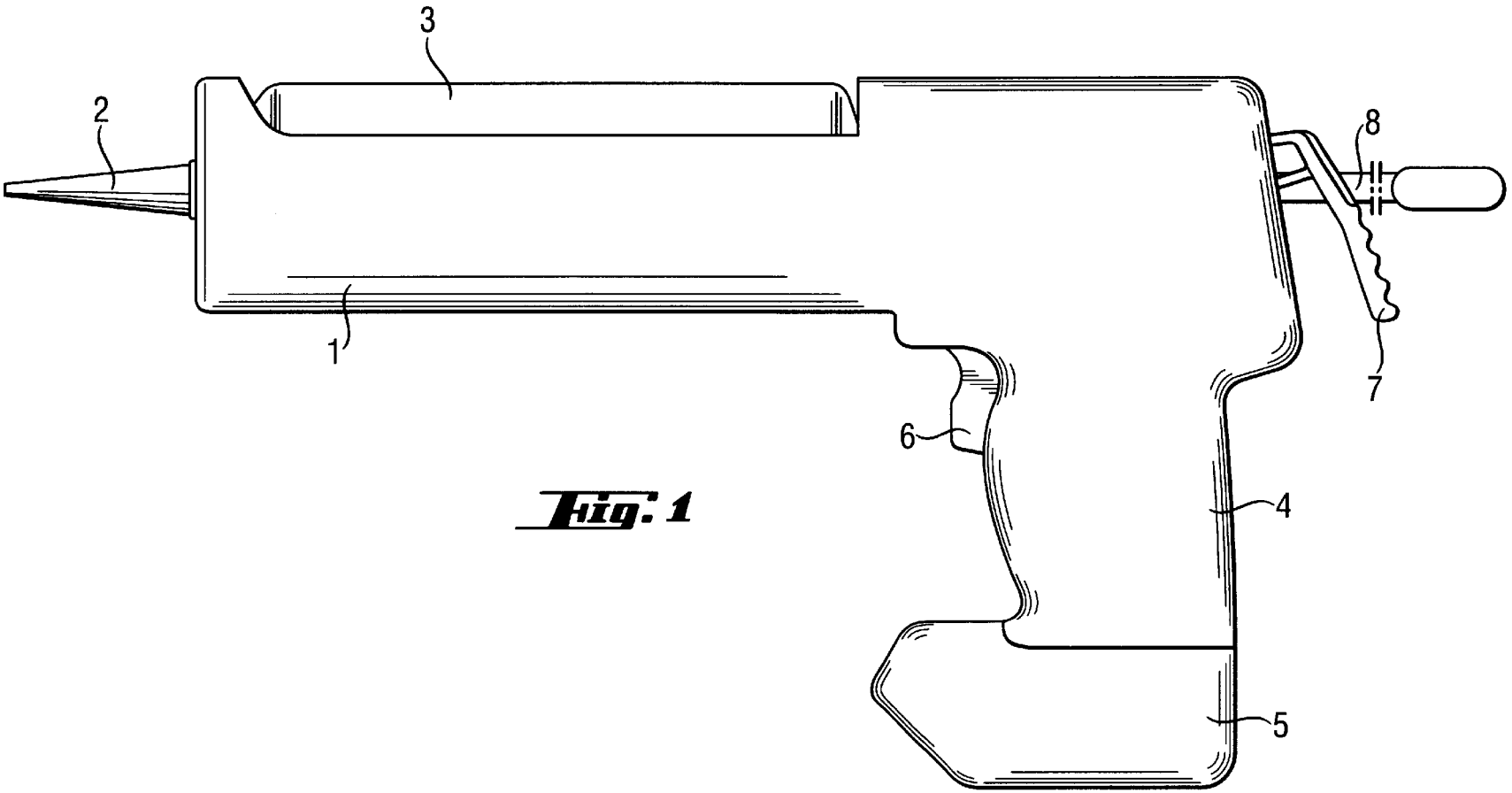
FIG. 1 a simplified side elevational view of a hand-held tool according to the present invention for squeezing a single component or multi-component mass out of a film bag.

A hand-held tool according to the present invention for squeezing a single component or multicomponent mass out of a film bag or bags, which is shown in FIG. 1, includes a housing 1 having an elongate receiving region with a large receiving opening through which two film bags 3 are inserted into the receiving region of the housing 1. FIG. 1 shows only one film bag 3 because the other film bag 3 is located immediately behind the visible film bag 3. The housing 1 has, at its front side facing in the squeeze-out direction, a squeeze-out nozzle 2. At is opposite, rear end, the housing is provided with a handle 4 with an actuation trigger 6. The actuation trigger 6 is arranged on the side of the handle 4 which faces in the squeeze-out direction. At the free end of the handle 4, there is provided a power source in form of an accumulator 5. The accumulator 5 is detachably secured to the handle 4. A release lever 7 and a portion of a piston rod 8 project from the rear and region of the housing 1.

Figure 2:
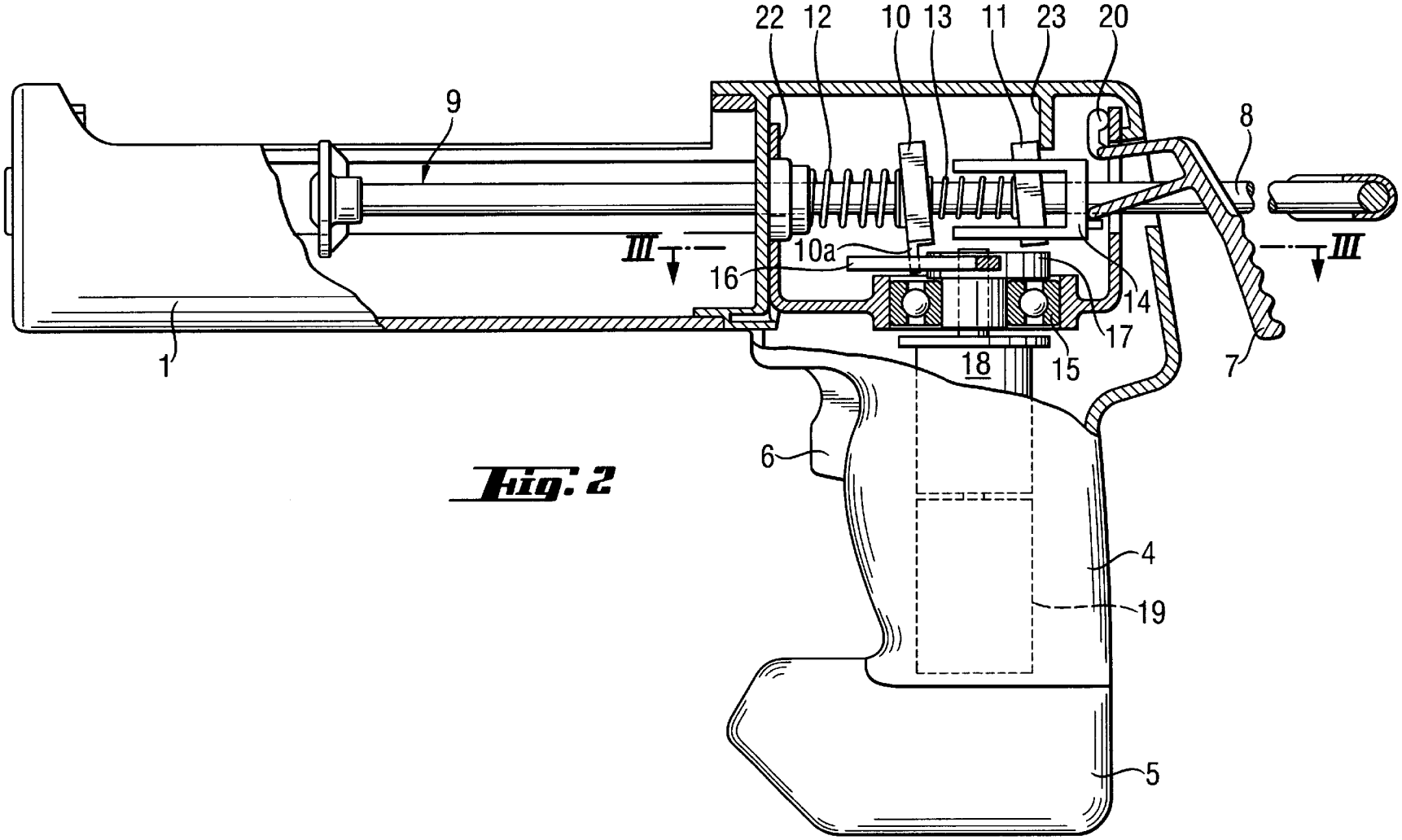
FIG. 2 a side partially cross-sectional view of the tool shown in FIG. 1 but without the film bag and the squeeze-out nozzle.

As shown in FIG. 2, there are no film bags in the receiving region of the housing 1, and a piston 9, which is connected with the piston rod 8, projects into the receiving region of the housing 1. The tool has two piston rods 8 which extend through an intermediate wall 22 of the housing 1. In FIG. 2, only on piston rod 8 can be seen because the other piston rod 8 is located immediately behind the visible piston rod 8. Below, the operation of the tool will be described with reference only to one piston rod 8.

Two clamping levers 10 and 11 are mounted on each piston rod 8 in a spaced relationship to each other. A spring 12, which surrounds the piston rod 8, is arranged between the intermediate wall 22 and the first clamping lever 10. A second spring 13 is located between the two clamping levers 10 and 11. Both springs 12 and 13 are compression springs. The spring or biasing force of the first spring 12 is greater than the spring or biasing force of the second spring 13.

Figure 3:
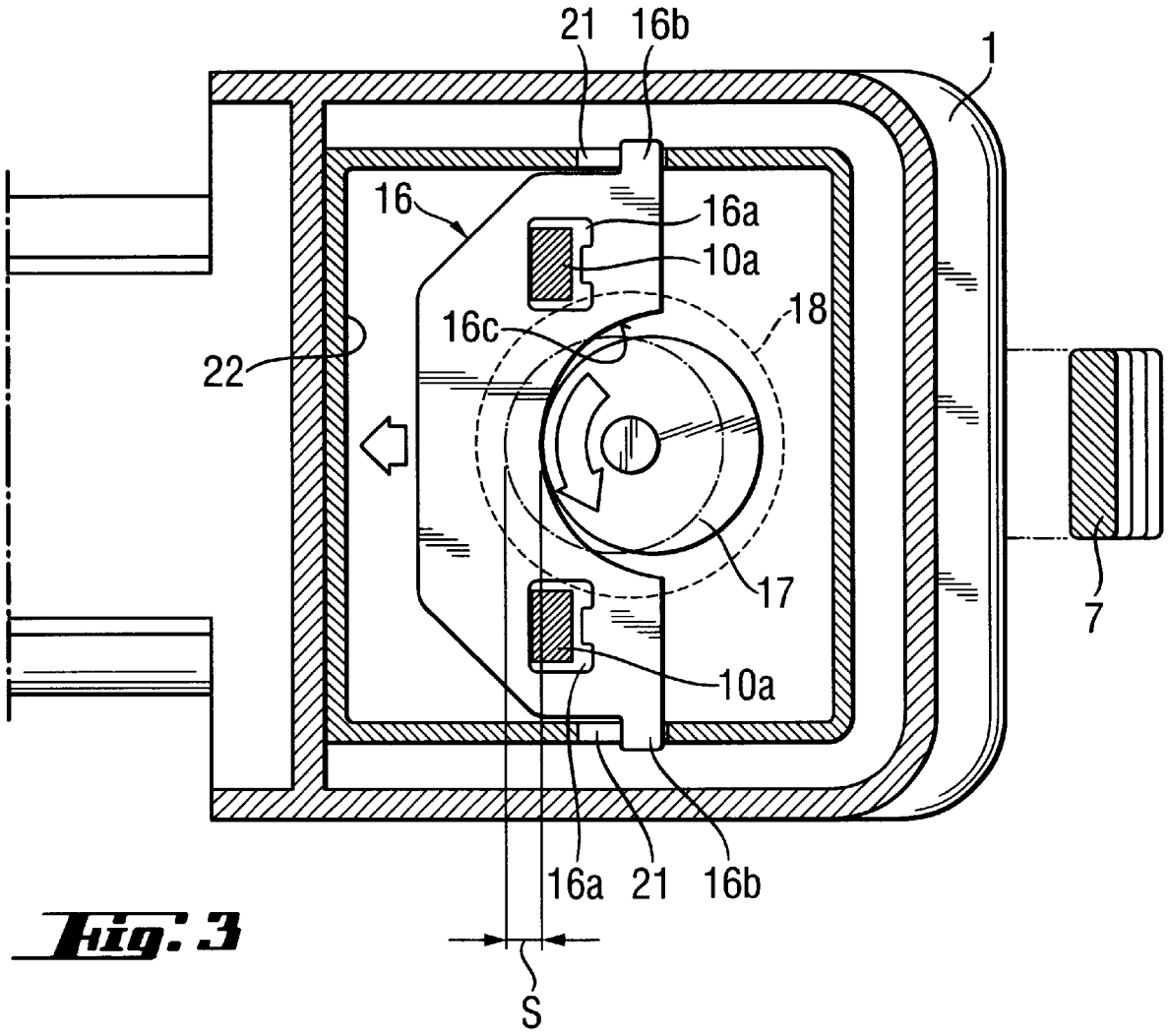
FIG. 3 a cross-sectional view along line III—III in FIG. 2.

The first clamping lever 10 has an entrained region 10*a* which extends through a through-opening 16*a* (see FIG. 3) formed in a slide 16. The entrained region 10*a* is biased by the first spring 12 against a shoulder of the through-opening 16*a* facing in the squeeze-out direction, and into a position in which it is inclined with respect to the piston rod 8 so that the mouth regions of a bore (not shown), through which the piston rod 8 extends, are clamped by the surface of the piston rod 8.

The second clamping lever 11 is biased by the second spring 13, which is supported against the first clamping lever 10, against a stop surface of a stop 23 provided in the housing 1. This stop surface is provided outside of the center of the second clamping lever 11. As a result of this, the second clamping lever 11 is biased by the second string 13 into a position in which the second clamping lever 11 is inclined with respect to the piston rod 8, so that the mouth regions of a bore (not shown), through which the piston rod 8 extends, are likewise clamped by the surface of the piston rod 8.

In order to squeeze a single or multicomponent mass out of the film bag 3, the piston rod 8 should be displaced from an initial position, in which the piston 9 is located in the region of the intermediate wall 22, to an end position in which the piston 9 is located in the end region of the housing 1 at the squeeze-out side of the housing 1. In a tool according to the present invention, the displacement of the piston rod 8 in the squeeze-out direction is effected by an electric drive motor 19 the drive shaft of which extends substantially transverse to the longitudinal axis of the piston rod 8. The electrical power, which is necessary for driving of the electric motor 19, is supplied by the accumulator 5 which is detachably mounted, as it has already been discussed above, at the full end of the handle 4. The drive motor 19 is turned on and off by the actuation trigger 6 provided on the handle 4. The high rotational speed of the drive motor is reduced by reducer 18 which is arranged between the drive motor 19 and the slide 16.

An output shaft of the reducer 18, which extends substantially transverse to the longitudinal axis of the piston rod 8, extends through a bearing 15 and is fixedly connected with an eccentric disc 17 which is arranged in the same plane as the slide 16.The slide 16 has a semi-circular opening, which faces in a direction opposite to the squeeze-out direction and the inner profile 16*a* of which abuts the outer profile of the eccentric disc 17. Upon actuation of the drive motor 19, the eccentric disc 17 begins to rotate, displacing the slide 16 in the squeeze-out direction by a distance S which corresponds to the eccentricity of the eccentric disc 17. The slide 16 is guided in the housing 1 by its lugs 16*b* which project into associated slots 21 in the housing and are displaced therein. Because the first clamping lever 10 is inclined relative to the piston rod 8, and the entrained region 10*a* of the first clamping lever 10 form-lockingly cooperates with the slide 16, the piston rod 8 is displaced in the squeeze-out direction by an amount equal to the eccentricity of the eccentric disc 17. The inclination or clamping of the second clamping lever 11 with respect to the piston rod 8 is released by the displacement of the piston rod 8 in the squeeze-out direction, whereby the second clamping lever 11 occupies, during the duration of the displacement of the piston rod 8 in the squeeze-out direction, a position in which it extends substantially perpendicular to the longitudinal axis of the piston rod 8. In this position of the second clamping lever 11, the piston rod 8 is freely displaceable relative to the second clamping lever 11.

As soon as the eccentric disc 17 crosses the largest point of its eccentricity, the first clamping lever 10 is brought by its entrained region 10*a* and the slide 16, as a result of displacement of the slide 16 in a direction opposite to the squeeze-out direction, into a position in which it extends transverse to the longitudinal axis of the piston rod 8. This position of the first clamping lever 10 insures its unobstructed displacement in the direction opposite to the squeeze-out direction relative to the piston rod 8. Simultaneously, the second spring 13 biases the second clamping lever 11 into its inclined, with respect to the piston rod 8, position in which the second clamping lever 11 again becomes clamped on the piston rod 8. In this way, the piston rod 8 is secured against axial displacement until the slide 16 is again displaced by the eccentric disc 17 in the squeeze-out direction. The displacement of the first clamping lever to in a direction opposite to the squeeze-out direction, is effected by the first spring 12 which is supported against the intermediate wall 22. The slide 16, which is form-lockingly connected with the first clamping lever 10, is displace therewith in the direction opposite to the squeeze-out direction.

In order to be able to return the piston rod 8 into its initial position after completion of a squeeze-out process manually, the clamping of both clamping levers 10, 11 on the piston rod 8 should be released so that the piston rod 8 can be displaced in the direction opposite to the squeeze-out direction. The release or lifting of the clamping action of the two clamping levers 10 and 11 is effected with a transfer member 14 through which the piston rod 8 extends and the fingers of which extending in the squeeze-out direction partially wrap around the second clamping 11. The transfer member 14 has a rear surface which is subjected to action of a release lever 7. The lever 7 pivots about a pivot point 20 provided in the housing 1 and has a profiled contact surface. When an operator applies pressure, e.g., with his thumb to the contact surface of the release lever 7, the release lever 7 would pivot about the pivot point 20 in the squeeze-out direction. The pivotal movement of the release lever 7 will cause displacement of the transfer member 14 likewise in the squeeze-out direction. Upon displacement of the transfer member 14 in the squeeze-out direction, the surface of the transfer member 14, which faces in the squeeze-out direction, and its fingers will bring both clamping levers 10 and 10 into a position in which they would extend transverse to the longitudinal axis of the piston rod 8, and the piston rod 8 can be displaced to the initial position as it is not subjected to the clamping action anymore.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A tool for squeezing a single-component or multicomponent mass out of film bag or cartridge means, the tool comprising at least one piston rod (8) connected with means acting on the film bag or cartridge means; a displacement mechanism for displacing the piston rod (8) and including at least two axially displaceable clamping levers (10, 11) arranged on the piston rod (8) and pivotable in a longitudinal direction of the tool, with one of the at least two levers serving for displacement of the piston rod and another of the at least two levers serving for locking the piston rod, at least two springs (12, 13) cooperating with the clamping levers (10, 11), and a release lever (7) cooperating with the clamping levers (10, 11); and a drive mechanism for actuating the displacement mechanism and including a rotatable eccentric disc (17) cooperating with the one of the at least two clamping levers, wherein the drive mechanism comprises a drive motor (19), and wherein the eccentric disc (17) is operationally connected with an output shaft of the drive motor (19) for joint rotation therewith.

2. A tool according to claim 1, wherein the eccentric disc (17) has an eccentricity from about 0.5 to about 20 mm.

3. A tool according to claim 1, wherein the drive mechanism comprises a reducer (18) arranged between the drive motor (19) and the eccentric disc (17).

4. A tool according to claim 1, further comprising a handle (4) and a trigger (6) provided on a handle (4) for turning the drive motor (19) on and off.

5. A tool according to claim 4, wherein at least the drive motor (19) is located in the handle (4).

6. A tool according to claim 1, wherein the drive motor (19) is an electric motor.

7. A tool according to claim 6, further comprising at least one accumulator (5) for supplying electrical power to the electric drive motor (19).

* * * * *